US006976714B2

(12) United States Patent
Dionysian et al.

(10) Patent No.: US 6,976,714 B2
(45) Date of Patent: Dec. 20, 2005

(54) CABINET DOOR SYSTEM

(76) Inventors: Ara Dionysian, 12550 Allin St., Los Angeles, CA (US) 90066-6718; Emil Dionysian, 12550 Allin St., Los Angeles, CA (US) 90066; Alex Dionysian, 12550 Allin St., Los Angeles, CA (US) 90066

( * ) Notice: Subject to any disclaimer, the term of this patent is extended or adjusted under 35 U.S.C. 154(b) by 0 days.

(21) Appl. No.: 10/746,771

(22) Filed: Dec. 23, 2003

(65) Prior Publication Data

US 2005/0134055 A1 Jun. 23, 2005

(51) Int. Cl.[7] ..... E05C 19/06
(52) U.S. Cl. ..... 292/80; 292/81
(58) Field of Search ..... 292/80, 81, 85, 292/87, 253, 82, 83, 86, DIG. 61; 312/329, 312/351, 138.1

(56) References Cited

U.S. PATENT DOCUMENTS

| | | | | | |
|---|---|---|---|---|---|
| 146,765 | A | * | 1/1874 | Keith | 292/85 |
| 493,203 | A | * | 3/1893 | Badoni | 292/87 |
| 763,426 | A | | 6/1904 | Rissner | |
| 1,014,755 | A | * | 1/1912 | Jette | 292/85 |
| 1,092,651 | A | * | 4/1914 | Jordan | 312/333 |
| 1,313,840 | A | * | 8/1919 | Strom | 292/175 |
| 2,443,515 | A | * | 6/1948 | Rockwell | 312/324 |
| 3,039,802 | A | | 6/1962 | Barry | 292/19 |
| 4,023,839 | A | * | 5/1977 | Bisbing | 292/85 |
| 4,556,244 | A | | 12/1985 | Bisbing | 292/65 |
| 4,715,628 | A | | 12/1987 | Brink et al. | 292/19 |
| 5,312,143 | A | | 5/1994 | Buckner | 292/230 |
| 5,597,188 | A | | 1/1997 | Miché | 292/183 |
| 5,618,070 | A | | 4/1997 | Tunis et al. | 292/228 |
| 5,975,593 | A | * | 11/1999 | Cress | 292/86 |
| 6,415,476 | B1 | | 7/2002 | McCoy | 16/257 |
| 6,464,102 | B1 | * | 10/2002 | Harmon et al. | 220/835 |
| 6,588,809 | B1 | | 7/2003 | Derman | 292/129 |

* cited by examiner

*Primary Examiner*—Gary Estremsky
(74) *Attorney, Agent, or Firm*—Cislo & Thomas, LLP

(57) ABSTRACT

Provided are exemplary embodiments that may include a cabinet door securing system, including, a post, a biasing member configured to disengagedly couple to the post, a knob coupled to a door, and a moveable shaft coupled to the knob, configured to couple to the plate spring, and configured to move from an actuated position to an unactuated position, wherein the plate spring couples to the post when the moveable shaft is in an unactuated position, and may be uncoupled from the post when said moveable shaft is in an actuated position.

5 Claims, 2 Drawing Sheets

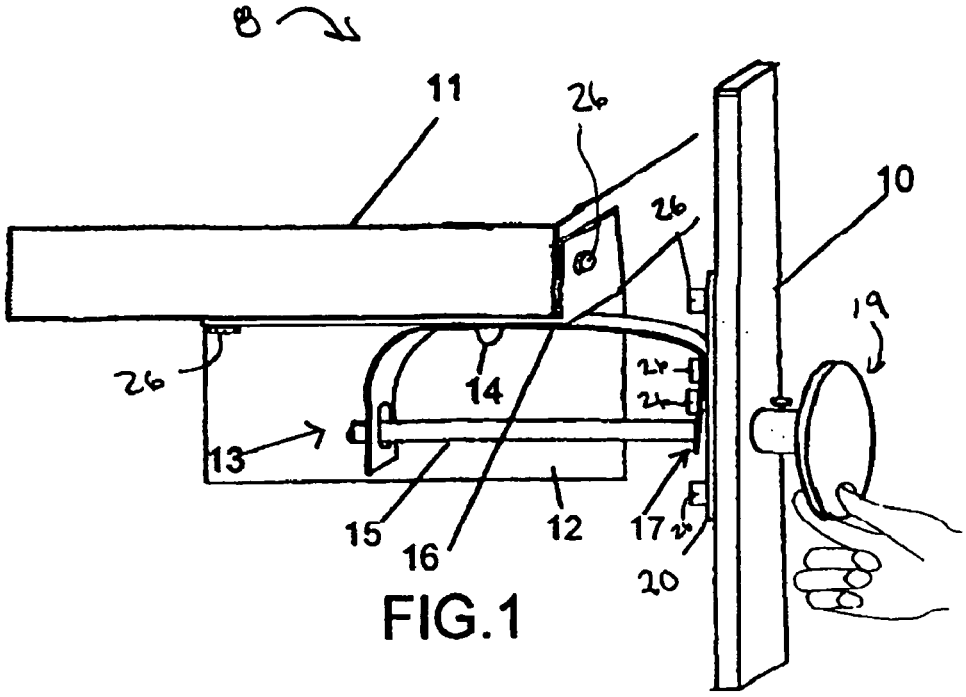
FIG.1
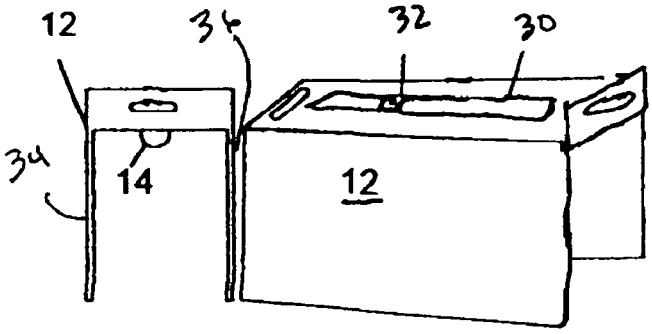
FIG.2 FIG. 2a
FIG. 3
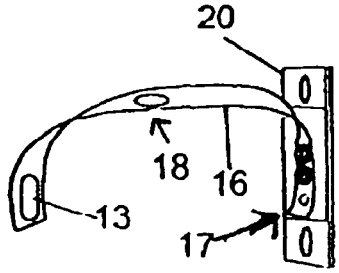

CABINET DOOR SYSTEM

BACKGROUND

Some interior doors may utilize a knob or other similar method to secure the door in the closed position. However, these types of securing configurations may not typically be used for kitchen and other cabinet doors. Kitchen and other cabinet doors may be kept closed by spring-equipped hinges or by gravity closing means. These configurations may not operate satisfactorily when it is intended that children are to be kept out of the cabinet, or during an earthquake or other event when the contents of the cabinet may move.

What is needed is a securing configuration that will allow the door to remain secured to the cabinet until unsecured by a user.

SUMMARY

Provided are exemplary embodiments that may include a cabinet door securing system, including, a post, a biasing member, or plate spring, configured to disengagedly couple to the post, a knob coupled to a door, and a moveable shaft coupled to the knob, configured to couple to the plate spring, and configured to move from an actuated position to an unactuated position, wherein the plate spring couples to the post when the moveable shaft is in an unactuated position, and may be uncoupled from the post when said moveable shaft is in an actuated position.

BRIEF DESCRIPTION OF THE DRAWINGS

FIG. 1 is a perspective view of a system according to an exemplary embodiment.

FIG. 2 is an end elevation view of a bracket according to an exemplary embodiment.

FIG. 2*a* is a perspective view of a bracket according to an exemplary embodiment.

FIG. 3 is a perspective view of a plate spring according to an exemplary embodiment.

DETAILED DESCRIPTION

Figure 4:
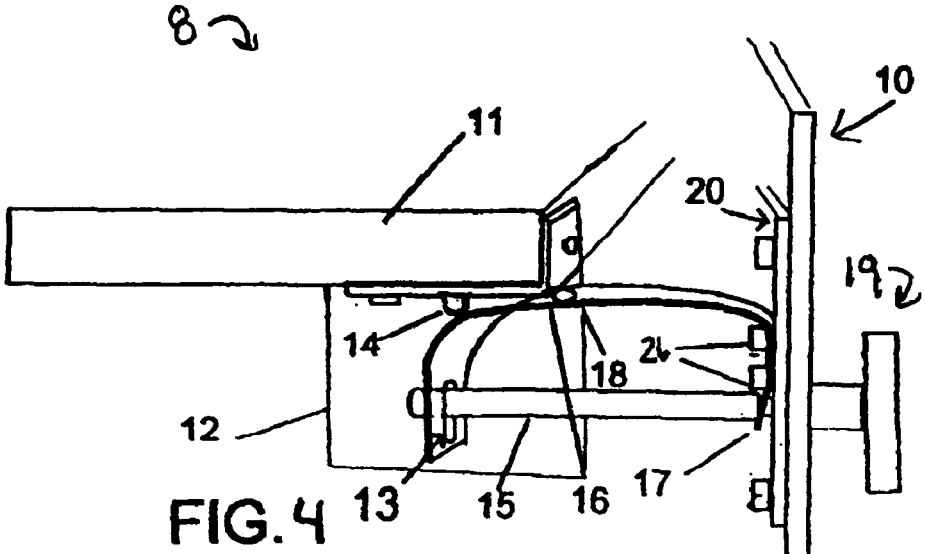
FIG. 4 is a side elevation view of a system according to an exemplary embodiment.

The detailed description set forth below in connection with the appended drawings is intended as a description of exemplary embodiments and is not intended to represent the only forms in which the embodiments may be constructed and/or utilized. The description also sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

A cabinet door securing system, according to an exemplary embodiment, is shown in FIG. 1, generally at 8. System 8 may include a door 10, a shelf or interior of the cabinet 11, and a shelf bracket 12 that is configured to couple to shelf 11 or the interior of a cabinet. System 8 may also include a biasing member, or plate spring, 16 which may include a distal end orifice 13 and a proximal end orifice 17.

System 8 may also include a shaft 15, which may couple to plate spring 16 via orifices 13 and 17. System 8 may also include a post 14 which may be configured to couple to plate spring 16, to secure the door in the closed position.

As shown, shaft 15 is in the actuated position when a user lifts on the bottom portion of a handle 19 connected to shaft 15 that disengages plate spring 16 from post 14 to allow the door to move away from the cabinet or other device. The system may further include handle 19, which may be coupled to shaft 15 to allow the above-described movement. System 8 may also include a doorplate 20 which may be coupled to door 10 and may also be coupled to plate spring 16. As shown, biasing member 16 will bias shaft 15 in an unactuated position such that when biasing member 16 is coupled to post 14 it will not disengage.

Biasing member 16 may be a plate spring, as shown; however, other configurations may be utilized, as desired. Biasing member/plate spring 16 may be made from a metal, plastic, other materials, or combinations thereof, as desired. Similarly shaft 15 may be made of a metal, plastic, wood, or combinations thereof, among other materials, as desired. Plate spring 16 may also be configured to allow the door to move towards the cabinet and allow post 14 to slide along the upper surface of plate spring 16 until it reaches an aperture that may couple post to plate spring 16.

System 8 may further include fasteners 26 which may fasten doorplate 20 to door 10 as well as to plate spring 16. Furthermore, fasteners 26 may also fasten to bracket 12 to shelf 11. Although a screw or bolt has been shown it will be appreciated that other fastening configurations and methods may be utilized including nails, adhesives, and other configurations and methods, as desired. With this configuration the door may remain closed until a user actuates the system by lifting up on the bottom of handle 19, such that the door will remain closed until shaft 15 is actuated. With this configuration children may not be able to open the door, as well as when earthquakes occur plates and other objects forced into the door may not open the door.

FIG. 2 is an end elevation view of bracket 12, according to an exemplary embodiment. As shown, bracket 12 may have two legs/sidewalls 34 and 36, however it will be appreciated that these legs/sidewalls are not necessarily needed but may be included to further enhance the system. Also shown is post 14 coupled to bracket 12. Although post 14 is shown as coupled to bracket 12, it will be appreciated that post 14 may also be directly connected to the interior of the cabinet and/or a shelf within the cabinet, as desired. Furthermore other configurations may be utilized, as desired.

FIG. 2*a* shows a perspective view of bracket 12. As shown, the upper side of bracket 12 may include a channel 30 and an adapter 32 such that the position of post 14, not shown, may be selectively positional, as desired. Adapter 32 may be coupled to bracket 12 via channel 30 in many different positions, as desired. Correspondingly, post 14 may couple to adapter 32, thus making the position of post 14 relative to the door and the rest of the system, selectively positional, thus making the system highly configurable, as desired. Additionally, bracket 12 may include a lip and other mounting channels to make the position of bracket 12 selectively adjustable with relation to the interior of the cabinet. Furthermore, this configuration may make the system further adjustable and configurable, as desired.

FIG. 3 is a perspective view of a portion of a system, according to an exemplary embodiment. As shown, plate spring 16 includes a distal end orifice 13 and a proximal end orifice 17, which are configured to couple to shaft 15, not shown. Furthermore, plate spring 16 may include an aperture 18 that may be configured to couple to post 14, also not shown in this drawing, when the door is closed, or shaft 15 is in an unactuated position. Also shown in FIG. 3 is doorplate 20 shown coupled to plate spring 16.

FIG. 4 shows a system, according to an exemplary embodiment, with the door 10 moving towards shelf 11, or toward the interior of the cabinet. As shown, post 14 will slide along plate spring 16 until it reaches aperture 18. Post 14 may then engage aperture 18 to secure the system.

Shaft 15 is shown in the unactuated position, or its normal steady state condition when the door is securely closed. Again shown is doorplate 20 which may be fastened to door 10 via fasteners 26. Furthermore, shaft 15 extends through orifices 13 and 17, and plate spring 16 biases shaft 15 to the unactuated position. Shaft 15 may be coupled to handle 19 such that when a user moves handle 19 it may impart movement upon shaft 15.

Figure 5:
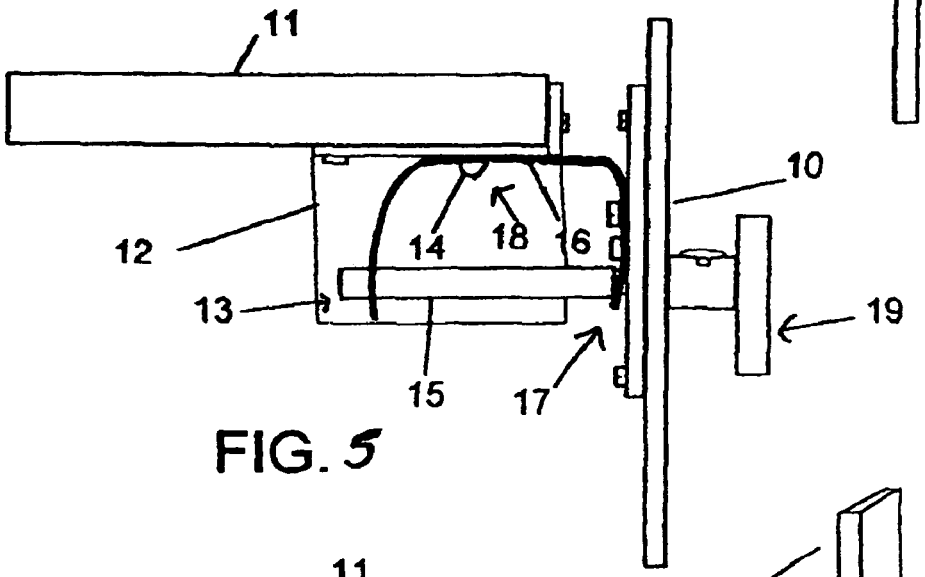
FIG. 5 is a side elevation view of a system according to an exemplary embodiment.

FIG. 5 shows a side elevational view of a system, according to an exemplary embodiment, with the door 10 in the closed position and shaft 15 in the unactuated position, such that post 14 extends through aperture 18 to couple post 14 to plate spring 16. As such, handle 19 may couple to shaft 15 via a setscrew, however other fastening configurations and methods may be utilized, as desired.

Figure 6:
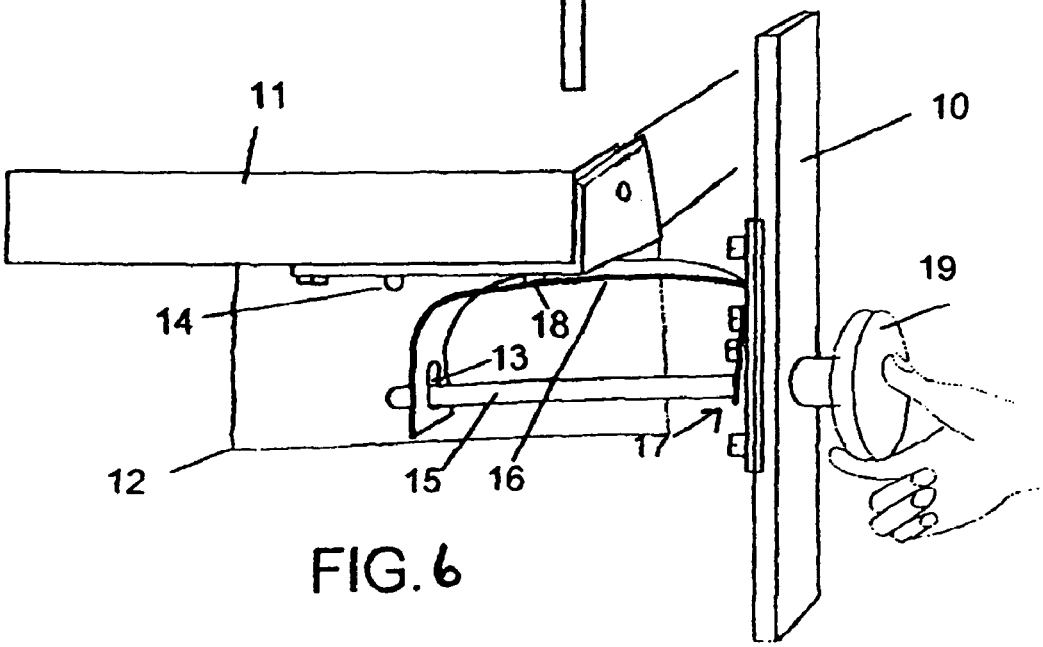
FIG. 6 is a perspective view of a system according to an exemplary embodiment.

FIG. 6 shows a perspective view of a system, according to an exemplary embodiment, with shaft 15 in the actuated position, thus plate spring 16 is uncoupled from post 14 and the door is opening and moving away from shelf 11. As shown, a user may lift up on the bottom of handle 19 to move shaft 15 downwardly within orifice 13 to move plate spring 16 away from post 14 such that post 14 will uncouple from plate spring 16. In this manner children may not be able to figure out how to open the door utilizing the system. Additionally, this may allow objects within the cabinet or other enclosure to remain inside the enclosure when an earthquake or other event occurs that may cause the contents to shift.

Bracket 12 may be made from a metal, wood, plastic, rubber, combinations thereof, or other materials, as desired. Similarly the other portions of the system may be made from similar materials, or other suitable materials, as desired. It will be appreciated that other configurations and devices may be used to create the same movements and configurations, as desired.

When the cabinet door 10 is pushed closed by a slight force, or some self-closing configuration, the plate spring 16 may advance by entering the housing plate 12, which is installed adjacent to the cabinet shelf board 11, until orifice 18 reaches to post 14. Post 14 may then engage orifice 18 to couple biasing member 16 to post 14, and thereby securing the door to the rest of the system. The door will remain secured until a user or other source of force lifts the lower end of knob 19, which actuates shaft 15, and thereby disengages plate spring 16 from post 14.

In closing, it is to be understood that the exemplary embodiments described herein are illustrative of the principles of the present invention. Other modifications that may be employed are within the scope of the invention. Thus, by way of example, but not of limitation, alternative configurations may be utilized in accordance with the teachings herein. Accordingly, the drawings and description are illustrative and not meant to be a limitation thereof. Thus, it is intended that the invention cover all embodiments and variations thereof as long as such embodiments and variations come within the scope of the appended claims and their equivalents.

What is claimed is:

1. A cabinet door securing system, comprising:

a post;

a biasing member mounted to a door and configured to disengagedly couple to said post;

a knob coupled to the door;

a moveable shaft coupled between said knob and said biasing member and configured to move from an actuated position to an unactuated position, said biasing member being coupled to said post when said moveable shaft is in an unactuated position and uncoupled from said post when said moveable shaft is in an actuated position, and wherein said biasing member comprises:

a distal orifice coupled to a distal end of said shaft;

a proximal orifice coupled to a proximal end of said shaft; and an aperture intermediate said proximal and distal orifices and engaging said post when in the unactuated position;

a selectively positional shelf bracket mounted to the interior of a cabinet and selectively positioning said post toward or away from the door, wherein said selectively positional shelf bracket includes a channel disposed in a direction generally perpendicular to the door; and an adapter being attached to said post, said adapter coupled to said selectively positional shelf bracket at a point along said channel selected by the user.

2. A cabinet door securing system, comprising:

a post;

a biasing member mounted to a door and configured to disengagedly couple to said post;

a knob coupled to the door;

a moveable shaft coupled between said knob and said biasing member and configured to move from an actuated position to an unactuated position, said biasing member being coupled to said post when said moveable shaft is in an unactuated position and uncoupled from said post when said moveable shaft is in an actuated position, and wherein said biasing member comprises:

a distal orifice coupled to a distal end of said shaft;

a proximal orifice coupled to a proximal end of said shaft; and an aperture intermediate said proximal and distal orifices and engaging said post when in the unactuated position; and a selectively positional shelf bracket including a channel disposed in a direction generally perpendicular to the door, wherein said post is adjustably mounted in said channel of said selectively positional shelf bracket in order to adjust the position of the door when said biasing member is in the unactuated position.

3. A cabinet door securing system, comprising:

a door;

a post;

a plate spring mounted to said door and having a proximal end, a distal end and an aperture within said plate spring therebetween;

a knob coupled to said door;

a moveable shaft attached to said knob and configured to couple to said plate spring, said shaft configured to move from an actuated position to an unactuated position;

a selectively positional shelf bracket configured to couple to the interior of a cabinet and selectively position said post relative to said shelf bracket; and a selectively positional door bracket configured to couple to said door and to said plate spring, wherein said plate spring engages said post via said aperture when said moveable shaft is in said unactuated position and disengages said post when said moveable shaft is in said actuated position to allow said door to open, said shelf bracket including a channel; and an adapter configured to couple to said shelf bracket adjacent said channel and to said post.

4. A cabinet door securing system, comprising:

a door;

a post;

a plate spring mounted to said door and configured to engage said post;

a knob coupled to said door;

a moveable shaft mounted to said knob and configured to couple to said plate spring, said shaft configured to move from an actuated position to an unactuated position, wherein said plate spring engages said post when said moveable shaft is in an unactuated position and disengages said post when said moveable shaft is in an actuated position;

a selectively positional shelf bracket configured to be mounted to a surface within the interior of a cabinet and selectively position said post relative to said surface of the interior of the cabinet, said shelf bracket including a channel oriented along a line generally perpendicular to said door; and an adapter coupled to said shelf bracket within said channel and mounted to said post.

5. A cabinet door securing system, comprising:

a door;

a post;

a plate spring mounted to said door and having a proximal end, a distal end and an aperture within said plate spring therebetween;

a knob coupled to said door;

a moveable shaft attached to said knob and configured to couple to said plate spring, said shaft configured to move from an actuated position to an unactuated position;

a selectively positional shelf bracket configured to couple to the interior of a cabinet and selectively position said post relative to said shelf bracket; and a selectively positional door bracket configured to couple to said door and to said plate spring, wherein said plate spring engages said post via said aperture when said moveable shaft is in said unactuated position and disengages said post when said moveable shaft is in said actuated position to allow said door to open, said shelf bracket including a channel; and an adapter configured to couple to said shelf bracket adjacent said channel and to said post, said channel being oriented in a direction that is substantially oblique to the back surface of said door when said door is closed.

* * * * *